US005660501A

United States Patent [19]

Herwegh

[11] Patent Number: 5,660,501

[45] Date of Patent: Aug. 26, 1997

[54] CORNER AREA FOR TUBBING SEALS

[75] Inventor: Norbert Herwegh, Schattdorf, Switzerland

[73] Assignee: Datwyler AG Schweizerische Kabel-, Gummi-und Kunstatoffwerke, Altdorf, Switzerland

[21] Appl. No.: 356,234

[22] PCT Filed: Apr. 11, 1994

[86] PCT No.: PCT/CH94/00072

§ 371 Date: Feb. 1, 1995

§ 102(e) Date: Feb. 1, 1995

[87] PCT Pub. No.: WO94/24417

PCT Pub. Date: Oct. 27, 1994

[30] Foreign Application Priority Data

Apr. 16, 1993 [CH] Switzerland ..... 01 166/93

[51] Int. Cl.[6] ..... E04F 15/14; E01C 11/02; E21D 11/00

[52] U.S. Cl. ..... 405/152; 52/393; 404/74

[58] Field of Search ..... 52/396.1, 656.9, 52/392, 393; 405/152; 404/37, 38, 39, 41, 74

[56] References Cited

U.S. PATENT DOCUMENTS

| | | | |
|---|---|---|---|
| 4,762,441 | 8/1988 | Glang | 405/152 |
| 4,900,607 | 2/1990 | Glang et al. | 404/37 X |

FOREIGN PATENT DOCUMENTS

| | | | |
|---|---|---|---|
| 306581 | 3/1989 | European Pat. Off. | 405/152 |
| 2655374 | 12/1989 | France . | |
| 406248892 | 9/1994 | Japan | 405/152 |
| 2193541 | 2/1988 | United Kingdom | 405/152 |
| 91/07571 | 5/1991 | WIPO | 405/152 |

*Primary Examiner*—Tamara L. Graysay
*Assistant Examiner*—Tara L. Mayo
*Attorney, Agent, or Firm*—Ladas & Parry

[57] ABSTRACT

A corner area has a corner piece which is inserted between two ends of the sealing profile strip of a sealing structure and is joined thereto. To facilitate the deformability of the corner piece when the sealing structure is pressed together under pressure, the structure has recesses. These recesses are disposed at an angle to cavities in the ends.

14 Claims, 1 Drawing Sheet

CORNER AREA FOR TUBBING SEALS

BACKGROUND AND SUMMARY OF THE INVENTION

The invention relates to a corner area of a sealing structure for tunnel tubing segments. The ends of two sides of the sealing structure meet at an angle. The sealing structure consists of sealing profile strips and a corner piece joining the ends of these strips. The sealing profile strips are provided, in cross-section, with grooves and cavities running continuously along their length and into the ends.

Tunnel tubing segments are typically rectangular, often slightly curved plates of concrete for lining excavated tunnels. In order to prevent water seepage from dripping into the tunnel, each tubing segment has along its four narrow sides or edges a continuous groove into which a sealing profile strip, which protrudes somewhat from it, is inserted. The tubing segments are installed under pressure such that they touch each other along common sides or edges. Thus, the sealing structures come to lie against each other side by side under high pressure, and are pressed completely into the tubing segment continuous groove. In the tunnel, they form a real sealing network which extends both over the arch of the tunnel and along the length of the tunnel. The sealing profile strips themselves are prefabricated industrially, by extrusion in any suitable length. They are then cut to the size which corresponds to the length of the sides of the tubing segments.

The cross-section of the continuous grooves in the tubing segment and that of the sealing profile strips, as well as the characteristics of their rubber material, must be carefully coordinated since conflicting conditions must be addressed in order to seal the tunnel perfectly. Thus, it is first necessary to take into account the fact that rubber, while readily deformable, is virtually incompressible, contrary to widely held opinion. The entire volume of rubber can be reduced only insignificantly under pressure. Consequently, the sealing profile strips must be provided with cavities disposed in their interior, which cavities can be deformed during installation under pressure in order to be able to force the profile strips into the continuous grooves. This is also important because, with the alignment of the tubing segments against each other, tolerances in the dimensions must constantly be taken into account.

There are still other conditions to consider. In order to accommodate the greatest possible tolerances, the sealing structure cross-section must be relatively large. The tubing segment continuous groove is, however, more susceptible to damage the larger it is. The continuous groove should thus be kept as small as possible. To achieve high leak resistance, relatively high sealing pressures are essential, and these are achieved better with a large cross-section of the sealing profile strip. On the other hand, due to cost considerations, a sealing structure cross-section as small as possible is preferable.

For this reason, the cross-section of the sealing profile strip and the cross-section of the continuous groove in the tubing segment are coordinated such that an optimally matched and shaped sealing profile strip cross-section can be deformed into as small a continuous groove cross-section as possible.

If the sealing profile strip cross-section is larger than the smallest possible continuous groove cross-section taking all possible tolerances into account, with the pressing of the tubing segments—which sometimes involves quite significant forces, it is possible that the edges or flanks of the continuous groove of the tubing segment may burst.

All of these conditions have an effect on the corner area of the sealing structure which is cut from the individual pieces of the extruded profile strip. The corner areas are produced by insertion of the pieces into a mold and subsequent injection of unvulcanized rubber into the empty corners of the mold. The rubber is vulcanized here by pressure and heat. Consequently, the design of the corner areas must be given special consideration with regard to the aforementioned conditions. This is easiest if the sealing profile strip has a curved cross-section but no cavities. Then this cross-section remains unchanged even at the corners. This is not the case with sealing profile strips with cavities or heavily undercut areas, since inserts applied in the cavity area cannot be removed after vulcanization and only with great difficulty with undercuts.

With the same cross-section in the corner area and sealing profile strip, there is deformation during the assembly in the corner area resulting in an enlargement of the cross-section since both ends of the sealing profile strip are compressed in the lengthwise direction thereof. This is expressed in an expansion of the cross-section. This effect becomes even greater if the material cross-section in the corner area is already enlarged by the production process.

Consequently, a solution must be found which makes it possible to reduce the material cross-section in the corner area so much that here as well, as in the area of the sealing profile strip, the material cross-section is not larger than the space available here defined by the cross-section of the joint. A larger material cross-section results here as well in a bursting effect, which causes the weaker joint flanks of the tubing segment to chip off.

According to the French Published Application No. 2,655,573, the proposal is made to reduce this material accumulation in the corner by making the profile strips smaller. This could be done on only one side of the corner, or on both sides meeting in the corner. Aside from the fact that, in the latter case, the pressing together of the two adjacent strips is virtually inevitable in the wedge-shaped opening thus formed, this type of material reduction has the disadvantage that the tolerance range in the direction of the width of the joint essential for compensation for imprecisions in assembly is reduced by the decreased depth of the profile.

The invention attempts to avoid these disadvantages and also takes into account the conditions mentioned above.

BRIEF DESCRIPTION OF THE DRAWINGS

Exemplary embodiments of a corner area according to the invention are shown in the accompanying drawings.

DETAILED DESCRIPTION OF PREFERRED EMBODIMENTS

Figure 1:
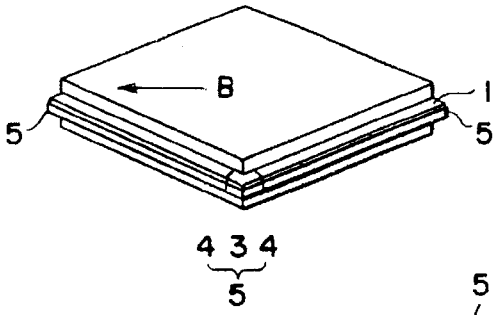
FIG. 1 is a tubing segment with its sealing structure.

FIG. 1 shows a tunnel tubing segment as is used by the hundreds for the lining of recently excavated tunnels. The tubing segment has a sealing structure 1 on its narrow sides, which is accommodated in a groove in sides of the tubing segment, the grooves not being visible in this figure. Each sealing structure comprises sealing profile strips 2 and corner pieces 3. The tubing segments are mounted together in checkerboard fashion both along the arch and in the lengthwise direction of the tunnel, under pressure, such that sealing structures 1 from adjacent tubing segments are pressed against each other and thus form a seal therebetween. Each sealing structure 1 is made up of sealing profile strips or sides 2 and of corner pieces 3 joining them. Each corner piece 3 forms a corner area 5 where ends 4 of two profile strips 2 meet. The corner areas, because of the conditions mentioned above and in particular because of the installation of the tubing segments under pressure, must be specially designed as described below.

Figure 2:
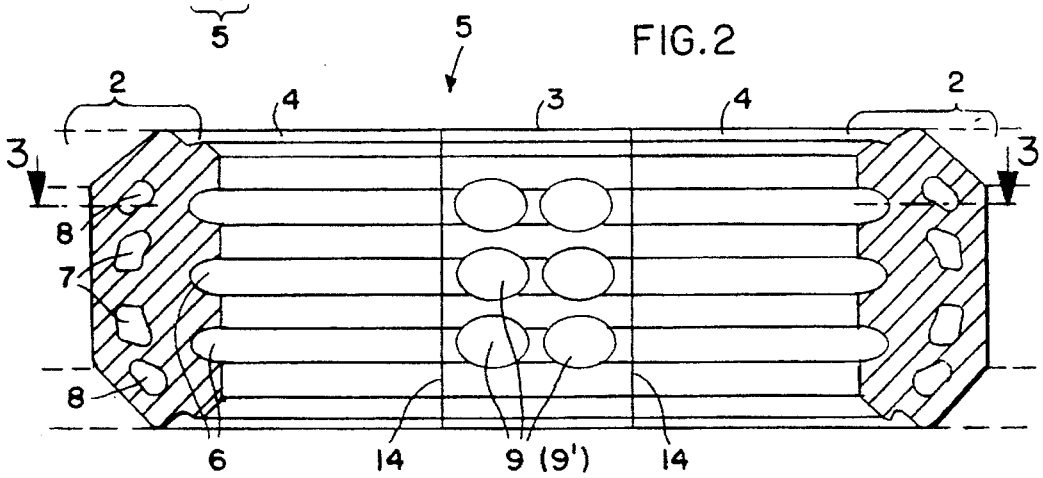
FIG. 2 is a view of a corner area of this sealing structure from the inside of the sealing structure.

The corner area 5 shown in FIG. 2 is viewed from the interior of the sealing structure 1, and, as is readily seen, in the line of sight along a diagonal of the sealing structure 1—see Arrow B of FIG. 1. The cross-section of the profile strips 2 is visible in FIG. 2, where only the ends 4 of profile strips 2 are depicted.

The sealing profile strip 2 forming sealing sides has grooves 6 and continuous internal and external cavities 7, 8 respectively in the lengthwise direction. In the tubing segment, the grooves 6 lie against the continuous groove of the tubing segment and partially serve for water drainage. However, the internal cavities 7 and the external cavities 8 are only present to enable deformation of the profile strip 2 under pressure from an identical structure of an adjacent tubing segment and thus to provide for a perfect seal. Through the extrusion process, the grooves 6 are of course also, like the cavities 7, 8, continuous, i.e., they extend into the ends 4.

The corner piece 3 is fabricated such that two profile strips 2 are inserted in each case into a mold at an angle to each other, usually less than 90° The mold is then closed and unvulcanized rubber is injected. Under heat and pressure, this vulcanizes very quickly and bonds with the profile strips 2 or their ends 4.

Figure 3:
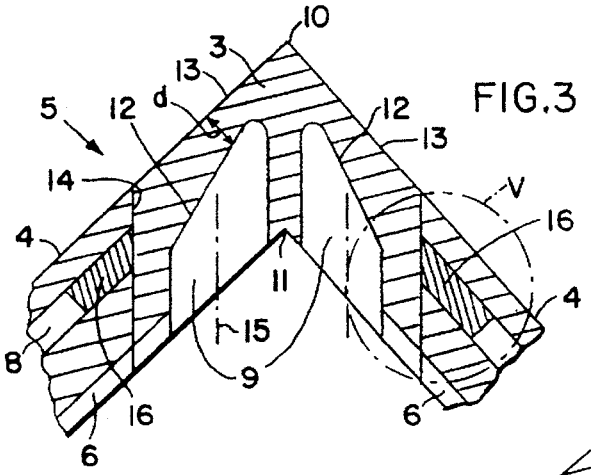
FIG. 3 is a section along the line A—A in FIG. 2.

The corner area 5, as shown for example in FIGS. 2 and 3, comprises the corner pieces 3 and ends 4 whereby end 4 is one end portion of the respective sealing strip 2. The length of the ends portion are not of concern.

As already mentioned, each profile strip 2 must be sufficiently deformable to be completely accommodated into the continuous groove of the tubing segment. Consequently, because of the rubber's very low compressibility, rubber corresponding to the volume of the mold cannot simply be injected into the mold. That could result in the corner piece 3 being formed into a solid body, with the danger also that, with the pressing together of the sealing structure 1, the profile strip 2 of the tubing segment adjacent to the tubing segment continuous groove would burst away. Care must therefore be taken that the total volume of rubber injected is at most as great as the volume of the corresponding corner on the continuous groove of the tubing segment. Consequently, recesses 9 must be provided The molding cores necessary to form these recesses 9 must, however, be disposed such that they can readily be removed after the injection. It is clear from this requirement that the recesses 9 cannot simply be continuations of the grooves 6 or the cavities 7, 8, since mold release would then be impossible.

Figure 4:
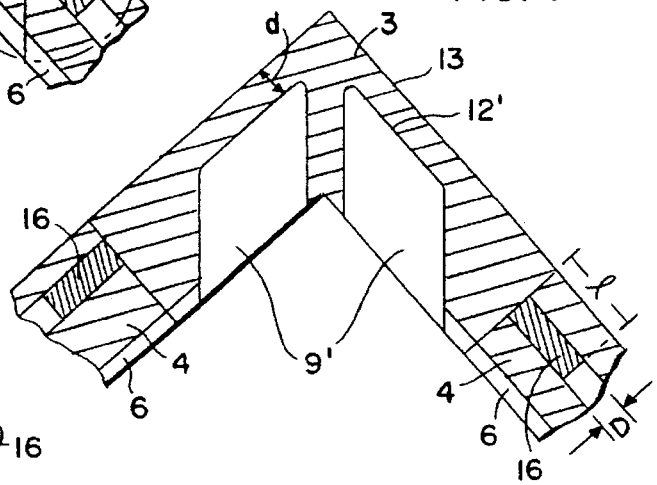
FIG. 4 is the same section as shown in FIG. 3, but in a different embodiment of the invention.

Consequently, the invention provides that the recesses, hereinafter referred to as 9 and 9', respectively, lie essentially at an angle to the grooves 6 and the cavities 7, 8 and are kept open toward the internal side of the sealing structure 1. The internal side is better suited to receiving the opening since the outer side of the sealing structure 1 forms the sealing surface and consequently should have no irregularities or interruptions. These recesses, 9 in the embodiment according to FIG. 3, 9' in the embodiment according to FIG. 4, are clearly visible in these Figures as well as in FIG. 2. Since the corner areas 5 are right angle pieces because of the usually square or rectangular tubing segment, it is preferable to position the recesses 9, 9' at about 45° in each case to the grooves 6 and the cavities 7, 8 of the adjacent end 4. For stability, in order to keep the recesses 9, 9' from becoming too large and yet to obtain the desired reduction in volume in the corner piece 3, they (the recesses 9, 9') are advantageously disposed on both sides of a diagonal which extends from an outer corner 10 of the corner piece 3 to an inner corner 11 thereof. As FIG. 2 shows, three recess 9, 9' are provided on top of one another on each side of the diagonal, i.e., there are just as many recesses 9, 9' as there are grooves 6 in the profile strip 2.

The two embodiments shown in FIGS. 3 and 4 differ from each other in two details. First, FIG. 3 depicts the preferred embodiment, which is, however, somewhat more expensive to produce. In FIG. 3, the recesses 9 each end in a plane 12 which runs at an angle to the corresponding external side 13 of the corner piece 3, such that the wall thickness d is thinnest in the vicinity of the corner 10 and increases continuously from there. In the embodiment according to FIG. 4, the plane 12' runs parallel to the external side 13, and thus the wall thickness d is constant. It is preferable that this wall thickness, or in FIG. 3 the smallest wall thickness, is at least one-third the diameter of the recesses 9, 9'. If the recesses 9, 9' are not circular in cross-section, but elliptical for example, as in FIG. 2, the wall thickness value is based on the shorter axis.

The second difference between the two embodiments consists in how the ends 4 of the profile strips 2 are cut. In FIG. 4, this cut is substantially perpendicular to the longitudinal axis of the side 2, which is certainly simpler from the point of view of production technology, but results in a greater mass of the corner piece 3. In FIG. 3, the cut is made before the insertion in the mold at an angle, advantageously at 45° , such that the faces 14 thus created run parallel to the lengthwise axes 15 of recesses 9. This reduces the volume of the corner piece 3 significantly, as is clear from a comparison of FIGS. 3 and 4.

In the manufacture of the sealing structure, there is a mold into which two sealing strips 2 are placed so that the end portions 4 thereof are at 90° to each other. Further, the end portions are at a certain distance with respect to each other, with the strips protruding from the mold. When rubber material is now injected into the mold, a corner piece 3 is formed which instantly vulcanizes with the two end portions 4 to form the corner area 5. This process is repeated until all four corner areas 5 are formed, resulting in the frame-like sealing structure.

In an alternative method to the above, a device comprising four molds for simulataneously forming these areas may be used. In any event, it is important to note that the recesses 9, 9' are formed by mold pieces which will then be retracted like pistons along line 15 shown in FIG. 3. Only after this retraction will it be possible to lift the corner area vertically off the mold. Any other position and/or shape of these mold pieces would lead to a form of the corner piece 3 that would present recesses and protrusions between the recesses. If the mold pieces were stationary, it would be impossible to move the protrusions formed below them in an upward direction. Only by disposing the recesses 9, 9' in the manner indicated above, and by using retractable mold parts, is it possible to form these corner areas and to bring them out of the mold.

In the injection of the corner piece 3 into the mold, it is necessary to pay attention to one additional circumstance to avoid an undesired enlargement of the volume of rubber injected. As mentioned, the cavities 7, 8 are open on said faces 14 of the ends 4. Since the injection process must take place at or above a certain minimal pressure in order to obtain a good bond between the corner piece 3 and its adjacent ends 4, part of the material injected would flow into the cavities 7, 8 and would fill them over a relatively long distance. This could result in a significant increase in the volume of the ends 4 and thus a sharp reduction in deformability. In order to avoid this, according to FIGS. 3 and 4, plugs 16 are inserted into the openings of the cavities 7, 8 (only those for the cavities 8 are shown) before the insertion of the sides 2 into the mold or continuous groove of the tubing segment. The protruding ends of the plugs 16 are cut off according to the shape of the respective faces 14, in FIG. 3 at an angle like the face 14.

Figure 5:
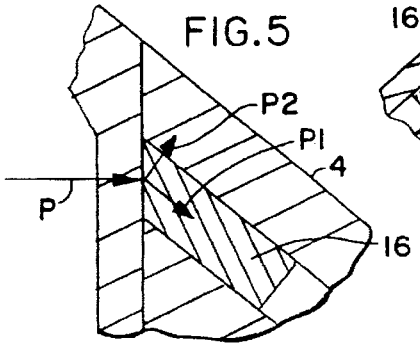
FIG. 5 is a detail denoted by the circle $v^6$ in FIG. 3 to depict the forces.

The angled cut has a significant advantage compared to the straight cut shown in FIG. 4. This is illustrated in FIG. 5. If the rubber is in fact introduced under pressure into the injection mold to form the corner piece 3, a force P acts on each plug 16 at a right angle to the face 14 and thus at a right angle to the angled end of the plug 16. This force P can be broken down into two components, namely, a component P1 on the longitudinal axis of the plug and a component P2 perpendicular to it. The component P2 presses the plug 16 even more forcefully against the wall of the cavity than would be the case from mere insertion.

Rubber cords of volume somewhat larger (approx. 10%) than the volume of the cavity 7, 8 to be filled can be used for the plugs 16. This results in application of pressure with the closing of the mold, which due to static friction, prevents the plug from being pushed along the cavity with the subsequent injection. This static friction can even be increased if, instead of the profile cords, small premolded parts having a wedge-shaped recess toward the injection area are used so that the static friction component is intensified.

The static friction component can be further intensified by using profile cords as plugs for the cavities, which plugs also have as rough a surface as possible based on the selection of material or fabrication.

By the combination of the measures, i.e, by the cylindrical diagonal recesses 9, 9' in the corner area 5 and by the closing of the cavity ends, it is possible to achieve the result whereby the total material volume in the corner area 5 is not greater than the volume of the tubing continuous groove available in the corner area 5.

In the analysis of the cross-section of the profile strip 2, or the ends 4 of the corner piece 3, there are three different cross-sections which must be coordinated with each other in the selection of materials and to address the expansion behavior such that under the high deformation pressure, any excess material (rubber) can be forced or can flow in the direction of the smaller volume of material.

The length l of a plug 16, or its shortest length with an angled cut, is at least equivalent to the shortest axis/diameter D of the cavity on the end plugged by it. Thus, on one hand, a good adhesion of the plug 16 is achieved, but on the other hand, the deformability of the end 4 is only insignificantly impacted.

I claim:

1. A corner area of a sealing structure for a tunnel tubing segment, the corner area comprising ends of two sealing profile strips of the sealing structure having axis meeting at an angle, a corner piece joining the ends, the sealing profile strips being provided with longitudinal grooves and cavities running continuously in a longitudinal direction into the ends, the corner piece having at least one recess with a longitudinal axis which runs at an angle to the grooves and cavities, the at least one recess opening at least toward an interior of the sealing structure.

2. The corner area according to claim 1, wherein the ends are at right angles to each other, and each recess in the corner piece runs at 45° to the cavities in these ends.

3. The corner area according to claim 1, wherein the number of recesses is two, and the recesses lie spaced apart on both sides of a diagonal running from an outer corner to an inner corner of the corner piece, the recesses having ends aligned with respective extensions of the longitudinal cavities.

4. The corner area according to claim 3, wherein on each side of the diagonal, there are as many recesses lying one over another as there are grooves in each sealing profile strip.

5. The corner area according to claim 3, wherein the recesses end in a plane in front of an external side of the corner piece, which plane runs parallel to the external side, to obtain a constant wall thickness.

6. The corner are according to claim 5, wherein the wall thickness is at least one-third of a diameter of one recess or of a shorter axis of said at least one recess with a noncircular cross-section.

7. The corner area according to claim 3, wherein the recesses end in a plane in front of an external side of the corner piece, which plane runs at an angle to the external side, such that wall thickness of the corner piece increases from an outer corner toward the ends of the sealing profile strips.

8. The corner are according to claim 7, wherein the wall thickness is a least one-third of a diameter of one recess or of a shorter axis of said at least one recess with a noncircular cross-section.

9. The corner area according to claim 1, wherein the ends of the sealing profile strips are cut at right angles to their longitudinal axes.

10. The corner area according to claim 1, wherein the ends of the sealing profile strips are cut at a 45° angle such that faces run parallel to the longitudinal axes of the recesses of the corner piece.

11. The corner area according to claim 3, wherein the cavities are closed with plugs.

12. The corner area according to claim 11, wherein each plug has a minimum length which corresponds to a diameter of the cavity plugged by it.

13. A corner area of a sealing structure for a tunnel tubing segment, the corner area comprising ends of two sealing profile strips of the sealing structure having axes meeting at right angles to each other and a corner piece joining the ends, the sealing profile strips being provided with longitudinal grooves and cavities running continuously in a longitudinal direction into the ends, the corner piece having at least one recess with a longitudinal axis which runs at an angle of 45° to the grooves and cavities, the at least one recess opening at least toward an interior of the sealing structure.

14. A corner area of a sealing structure for a tunnel tubing segment, the corner area comprising ends of two sealing profile strips of the sealing structure having axes meeting at an angle and a corner piece joining the ends, the sealing profile strips being provided with longitudinal grooves and cavities running continuously in a longitudinal direction into the ends, the corner piece having two spaced apart recesses lying on both sides of a diagonal running from an outer corner to an inner corner of the corner piece, each recess having a longitudinal axis which runs at an angle to the grooves and cavities, the recesses opening at least toward an interior of the sealing structure and having ends aligned with respective extensions of the longitudinal openings of the cavities.

* * * * *